US008657273B2

(12) United States Patent
Horiuchi et al.

(10) Patent No.: US 8,657,273 B2
(45) Date of Patent: Feb. 25, 2014

(54) JIG

(75) Inventors: Ryosuke Horiuchi, Hyogo (JP); Shoichi Bairaku, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 960 days.

(21) Appl. No.: 12/190,013

(22) Filed: Aug. 12, 2008

(65) Prior Publication Data

US 2010/0038835 A1 Feb. 18, 2010

(51) Int. Cl.
*B25B 1/00* (2006.01)

(52) U.S. Cl.
USPC ..... 269/47; 29/270

(58) Field of Classification Search
USPC ..... 269/47, 48, 49, 95; 29/244, 255, 270, 29/278
See application file for complete search history.

(56) References Cited

U.S. PATENT DOCUMENTS

| | | | | |
|---|---|---|---|---|
| 2,137,737 | A * | 11/1938 | Wenzel | 266/274 |
| 4,052,045 | A * | 10/1977 | Shaddix | 269/43 |
| 5,440,949 | A * | 8/1995 | Leibman | 464/180 |
| 5,745,968 | A * | 5/1998 | Genest et al. | 29/270 |
| 6,357,735 | B2 * | 3/2002 | Haverinen | 269/43 |
| 6,561,886 | B2 * | 5/2003 | Roberts et al. | 451/277 |
| 2010/0038835 | A1 * | 2/2010 | Horiuchi et al. | 269/47 |

FOREIGN PATENT DOCUMENTS

| | | | |
|---|---|---|---|
| JP | 4-180792 | A | 6/1992 |
| JP | 3-202244 | B2 | 11/1995 |
| JP | 9-079577 | A | 3/1997 |
| JP | 9-210361 | A | 8/1997 |
| JP | 10-196959 | A | 7/1998 |
| JP | 11-3553 | A | 1/1999 |

OTHER PUBLICATIONS

Japanese Office Action dated Feb. 1, 2011, issued in corresponding Japanese Patent Application No. 2006-037082.

* cited by examiner

*Primary Examiner* — Lee D Wilson
(74) *Attorney, Agent, or Firm* — Westerman, Hattori, Daniels & Adrian, LLP

(57) ABSTRACT

The jig 1 is used for positioning an inner tube and a transition piece of a combustor for a gas turbine when assembling the combustor. The jig 1 has the alignment member 2 that is inserted into the transition piece when positioning the transition piece to determine an installation position of the transition piece. The alignment member 2 has an outer circumferential shape which is substantially the same as an inner circumferential shape of the transition piece.

3 Claims, 5 Drawing Sheets

JIG

BACKGROUND OF THE INVENTION

1. Field of the Invention

The present invention relates to a jig. More particularly, this invention relates to a jig that facilitates positioning work of a transition piece in an assembly process for a gas turbine combustor.

2. Related Art Statement

A jig for positioning (aligning) an inner tube and a transition piece is employed in an assembly process for a gas turbine combustor. A jig 100 of a related art includes a dial gauge 101, a rotary unit 102 to which the dial gauge 101 is installed, a rod 103 that is fixed to the rotary unit 102, and a support member 104 that supports the rod 103 (see FIG. 8).

At the positioning work of the transition piece, the dial gauge 101 and the rotary unit 102 are inserted into an inlet portion of the transition piece that has been temporarily installed, and the support member 104 is installed in an installation spot (position for installing a top hat that retains an inner tube) of a chamber to fix the jig 100. At this positioning, the rotary unit 102 is coaxial with the inner tube. Rotating the rotary unit 102 causes the dial gauge 101 to rotate in a circumferential direction of the transition piece, and reading of the dial gauge 101 is read at each point in the circumference. Based on the measurement result, the position of the transition piece in the circumferential direction is fine adjusted until the reading of the dial gauge 101 at each point approximately equates with each other. Then, the transition piece is positioned on an appropriate position and is fixed.

There have been no published patent documents that disclose a jig for positioning a transition piece.

SUMMARY OF THE INVENTION

It is an object of the present invention to provide a jig that can facilitate positioning works of transition pieces in an assembly process of gas turbine combustors.

According to an aspect of the present invention, a jig for positioning an inner tube and a transition piece of a combustor for a gas turbine when assembling the combustor, includes an alignment member that has an outer circumferential shape which is substantially the same as an inner circumferential shape of the transition piece and that is, when positioning the transition piece, inserted into the transition piece to determine an installation position of the transition piece.

In the jig, an alignment member that determines the installation position of a transition piece has an outer circumferential shape which is substantially the same as an inner circumferential shape of the transition piece. Thus, when positioning the transition piece, the position of the transition piece with respect to the alignment member can be easily measured by inserting the alignment member into the transition piece. As a result, there is an advantage that positioning work for the transition piece can be made easy.

DETAILED DESCRIPTION OF THE INVENTION

The present invention is explained in detail below with reference to the accompanying drawings. The present invention is not limited by these examples, and the constituent elements in the examples include easily replaceable elements or substantially the same elements used by a person skilled in the art. A plurality of modified examples described in the example is optionally combinable within a scope that is obvious to a person skilled in the art.

Example 1

A combustor of a gas turbine includes an inner tube and a transition piece (not shown). The inner tube is installed in a chamber via an intermediate member of a so-called top hat. A fuel nozzle and a burner are inserted into the inner tube to be installed. The transition piece is installed in a rear stage of the inner tube, and is connected to a turbine vane array. In this combustor, a fuel injected from the fuel nozzle and compressed air supplied from a compressor is premixed in the inner tube to be ignited by the burner. The generated combustion gas is supplied to the turbine vane arrays through the transition piece.

Figure 1:
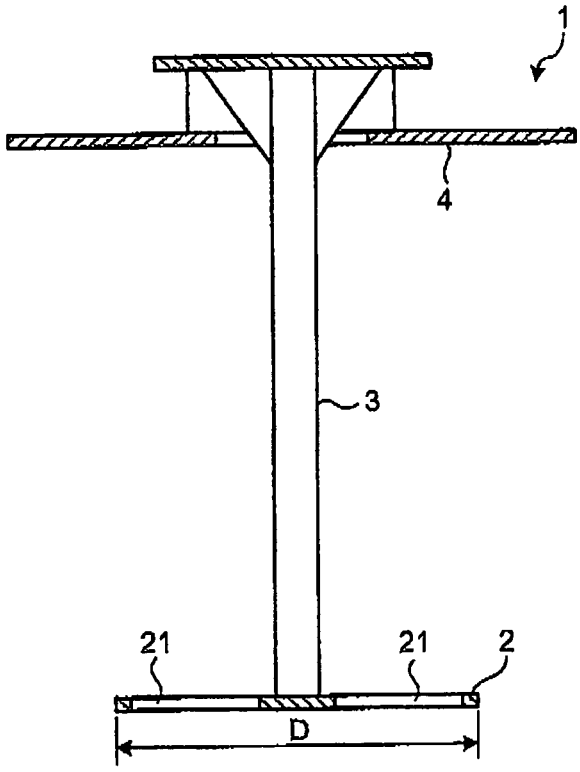
FIG. 1 is a side view illustrating an alignment jig for a transition piece according to an embodiment of the present invention.
Figure 2:
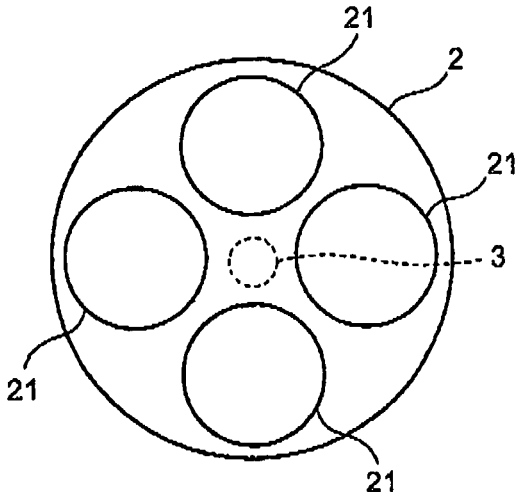
FIG. 2 is a front view illustrating the alignment jig for the transition piece according to the embodiment of the present invention.

In an assembly process of the combustor, a jig 1 is used for positioning (aligning) the inner tube and the transition piece (see FIG. 1 and FIG. 2). The jig 1 includes an alignment member 2, a rod 3, and a support 4. The alignment member 2 has an outer circumferential shape which is substantially the same shape as an inner circumferential shape of an inlet portion of the transition piece (inlet portion for combustion gas). When positioning the transition piece, the alignment member 2 is inserted into the transition piece to determine an appropriate installation position of the transition piece. For example, the inlet portion of the transition piece has the circular inner circumference, and accordingly the alignment member 2 has a circular shape of highly accurate circularity in this example. The alignment member 2 is made of stainless steel and has a plurality of holes 21 for weight saving. The rod 3 is fixed to the center of the alignment member 2 at its end with the longitudinal direction thereof being perpendicular to the surface of the alignment member 2. The support 4 supports the rod 3 in a fixed state. When positioning the transition piece, the support 4 is fixed to an installation portion of a chamber 11 by fastening a bolt. As a result, the alignment member 2 is fixed to a predetermined position through the rod 3 and the support 4. The installation portion of the chamber 11 is the spot where the top hat (not shown) for retaining the inner tube is installed.

Figure 3:
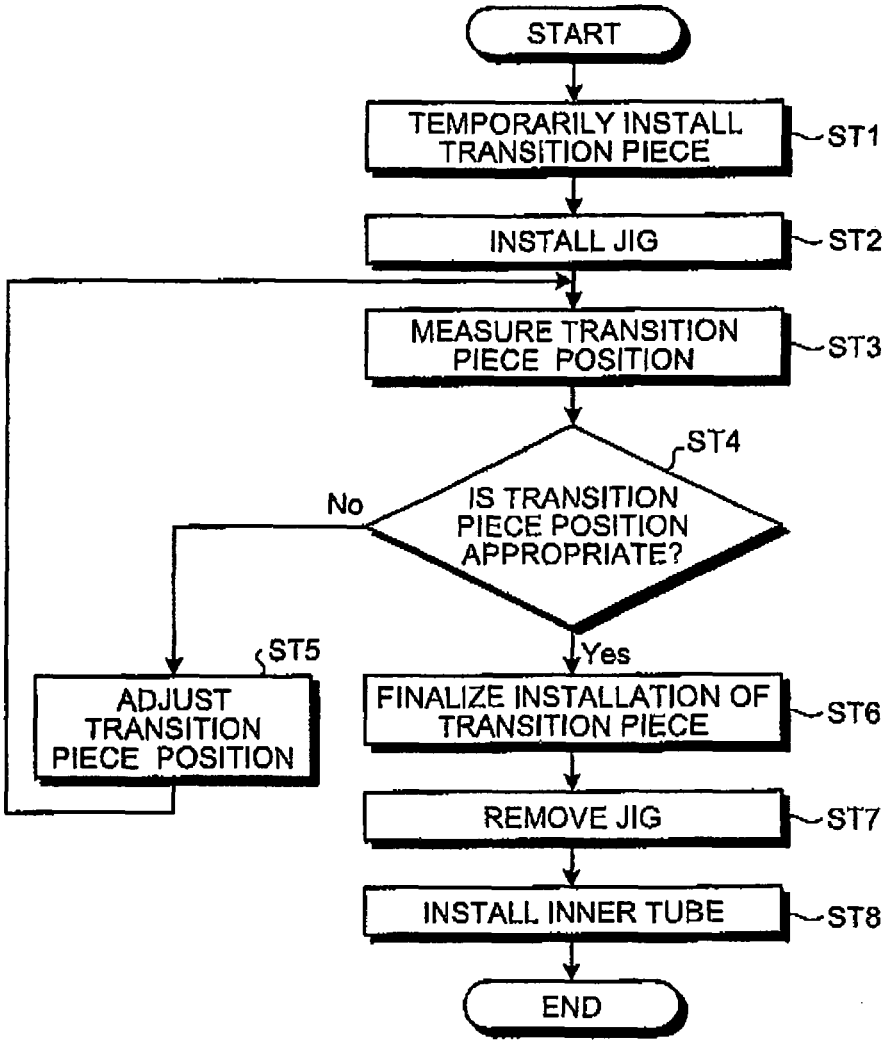
FIG. 3 is a flowchart explaining how to use the alignment jig for the transition piece shown in FIG. 1.
Figure 4:
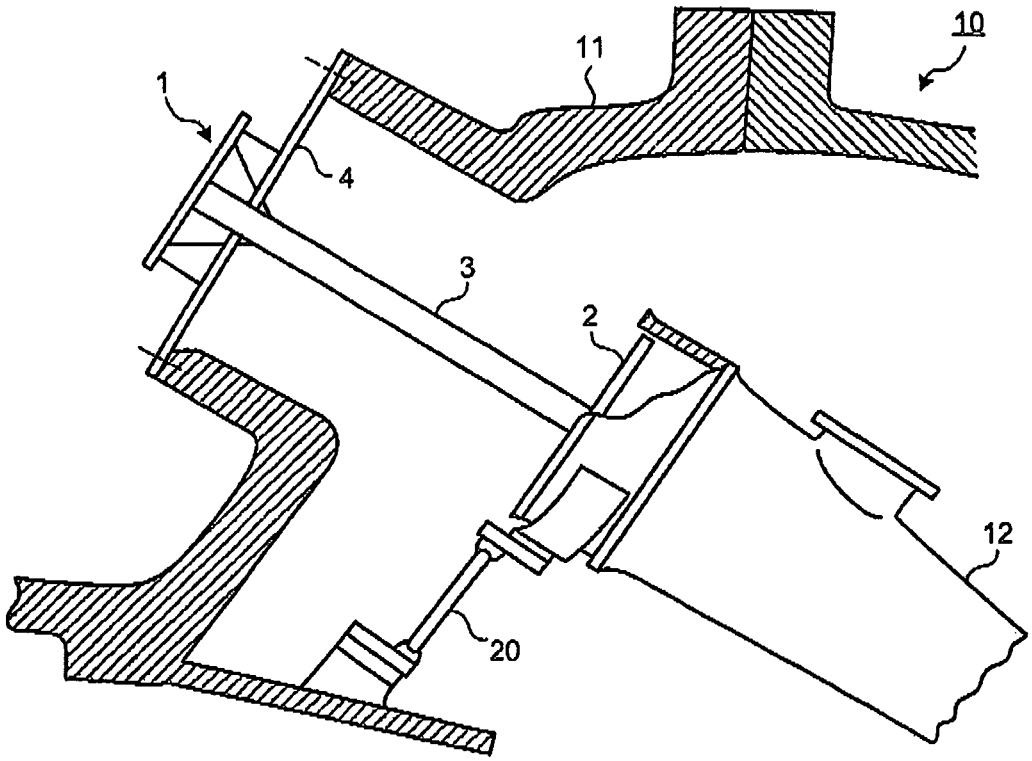
FIG. 4 is a schematic diagram explaining how to use the alignment jig for the transition piece shown in FIG. 1.

Positioning work of a transition piece 12 in a combustor 10 is performed as follows (see FIG. 3 to FIG. 5). First, the transition piece 12 is temporarily installed in the chamber 11 (ST1). The transition piece 12 is supported by a support 20 at the inlet portion and the outlet portion thereof is connected to a turbine vane array (not shown) to be fixed. The support 20 is fixedly installed in the chamber 11. Next, the jig 1 is delivered and mounted (ST2). The alignment member 2 is inserted into the inlet portion of the transition piece 12 that has been temporarily installed and the support 4 is installed in the installation portion of the chamber 11 to be fixed. At this time, the alignment member 2 is arranged in the position to be concentric with the inner tube (and the top hat) when being installed in the chamber 11. Therefore, the alignment member 2 determines an appropriate installation position (position to be concentric with the inner tube) of the transition piece 12.

Next, the installation position of the transition piece 12 is measured (ST3). In measuring the installation position, a taper gauge is used to measure a gap t between the inner circumference of the transition piece 12 and an outer circumference of the alignment member 2 (see FIG. 5). The measurement is performed at totally four points in the circumferential direction of the transition piece 12 at about 90 [deg] intervals. According to the result of the measurement, the installation position of the transition piece 12 is determined (ST4). When the measurement values of the four points generally match, the installation position of the transition piece 12 is determined as appropriate. Specifically, when the difference between the measurement values (gap t) is within a predetermined allowable assembly tolerance, it is determined as appropriate. In this example, the predetermined allowable assembly tolerance is set to within 1 [mm] for the diameter of the transition piece 12. Therefore, the gap t between the transition piece 12 and the alignment member 2 is measurable easily with the taper gauge.

When the four measurement values for determining the installation position of the transition piece 12 do not generally match, the installation position of the transition piece 12 is adjusted (ST5). Specifically, the torque of the support 20 that fixes the transition piece 12 is reduced and the position of the transition piece 12 is fine adjusted visually by a worker. On the contrary, when the installation position of the transition piece 12 is appropriate, the torque of the support 20 is increased and the installation of the transition piece 12 is finalized (ST6). Thereafter, the jig 1 is removed (ST7) and the inner tube (and the top hat) is inserted into the chamber 11 to be installed (ST8).

As mentioned above, in the jig 1, the alignment member 2 for determining the installation position of the transition piece 12 has the outer circumferential shape which is substantially the same as the inner circumferential shape of the transition piece 12. Therefore, when positioning the transition piece 12, the position of the transition piece 12 with respect to the alignment member 2 can be easily measured by inserting the alignment member 2 into the transition piece 12, thus providing an advantage that positioning work for the transition piece 12 can be made easy.

For example, when determining adequacy of the installation position of the transition piece 12, the above configuration allows measuring the gap t between the inner circumference of the transition piece 12 and the outer circumference of the alignment member 2 by the use of the taper gauge. Therefore, the workability of the measurement operation is improved compared with the jig of a related art for measurement using a dial gauge. Furthermore, the alignment member 2 is integral with the body of the jig 1 (having one-piece structure), so that the installation work of the jig 1 can be easier compared with the jig of a related art that needs mounting and dismounting of a dial gauge. Accordingly, an assembly time for the combustor 10 can be shortened.

Moreover, falling of the dial gauge into the inside of the transition piece 12 does not occur as occurred for the jig of a related art, so that damage on the transition piece 12 can be prevented. As mentioned above, measurement by a taper gauge is possible, so that errors in reading a gauge needle due to distortion of the transition piece 12 and the like hardly occur and the measuring error can be small. As a result, installation of the transition piece 12 is appropriately performed and reliability of a gas turbine is improved (quality is ensured).

Figure 5:
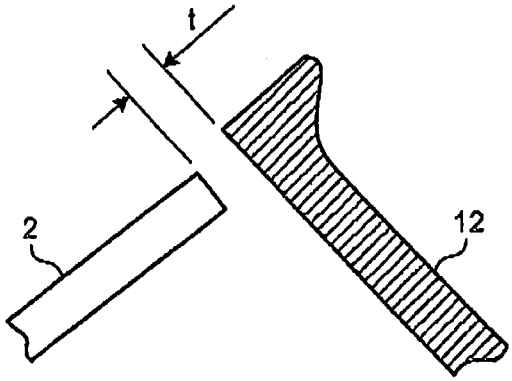
FIG. 5 is a schematic diagram explaining how to use the alignment jig for the transition piece shown in FIG. 1.

It is preferable that the outer diameter of the alignment member 2 be formed slightly smaller than the inner diameter of the transition piece 12 in the jig 1 (see FIG. 5). Specifically, the outer diameter of the alignment member 2 is determined to be smaller such that the gap t between the outer diameter of the alignment member 2 and the inner diameter of the transition piece 12 stays within a measurable range with a taper gauge. With this configuration, the alignment member 2 is insertable into the transition piece 12 even if some of the transition pieces 12 have individual differences (variance in the inner diameter). Therefore, there is an advantage that positioning of each of the transition pieces 12 can be performed appropriately with the single jig 1.

It is also preferable for the jig 1 that a hole or a concave is formed in the alignment member 2, so that the alignment member 2 is light weighed (see FIG. 2). For example, the holes 21 are formed symmetrically with respect to a center point of the alignment member 2 as the symmetrical point, so that the alignment member 2 can be light weighed. With this configuration, deflection of the rod 3 by the weight of the alignment member 2 can be reduced when installing the jig 1. Thus, the positional accuracy of the alignment member 2 can be improved, which consequently provides an advantage of reducing measurement errors when positioning the transition piece 12.

Figure 6:
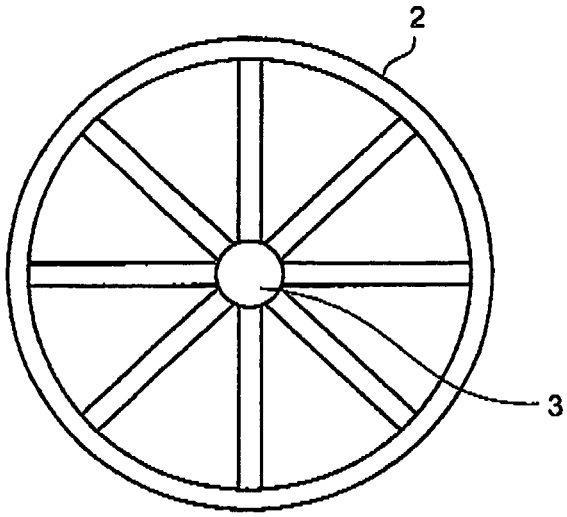
FIG. 6 is a schematic diagram illustrating a modified embodiment of the alignment jig for the transition piece shown in FIG. 1.

It is also preferable for the jig 1 that the alignment member 2 have a circular (and continuous) outer circumference when the inlet portion of the transition piece 12 has a circular inner circumference (see FIG. 2). For example, it is preferable that the alignment member 2 be an almost perfect circular disk (see FIG. 2) or an almost perfect annular ring (see FIG. 6). In the configuration, the alignment member 2 has the circular outer circumference, so that it is easy for a worker to visually check the positional relation between the alignment member 2 and the transition piece 12 when the alignment member 2 is inserted into the transition piece 12. Specifically, by comparing the positional relation between the inner circumferential line (circular) of the transition piece 12 and the outer circumferential line (circular) of the alignment member 2, positional deviation of the transition piece 12 is visually recognizable. Therefore, there is an advantage that the positioning work for the transition piece 12 can be made easy.

Figure 7:
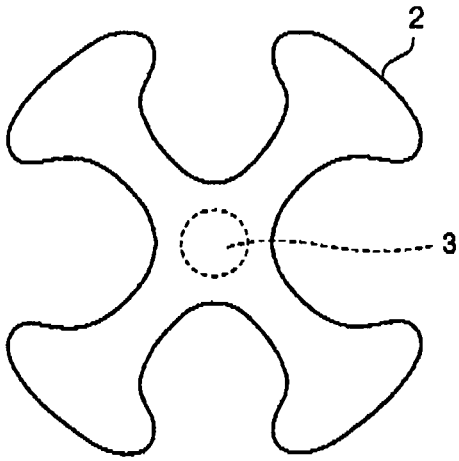
FIG. 7 is a schematic diagram illustrating a modified embodiment of the alignment jig for the transition piece shown in FIG. 1.
Figure 8:
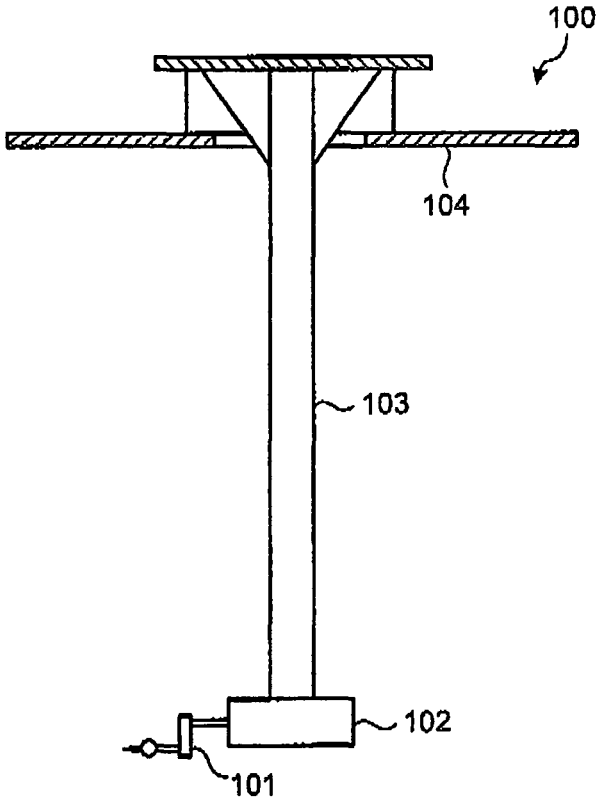
FIG. 8 is a side view illustrating an alignment jig for a transition piece of a related art.

It is also preferable that the alignment member 2 of the jig 1 have an outer circumferential shape that allows measurement of the positions of the transition piece 12 on at least four points. For example, the alignment member 2 can be such as cross-shaped (see FIG. 7). In the cross shape, at least four measurement points are ensured, so that there is an advantage that the installation position of the transition piece 12 can be measured within a sufficient measuring range (measurement at four points). Theoretically, the installation position of a transition piece 12 can be measured by the alignment member 2 configured to be triangle-shaped, for example. However, such configuration leads to lowering of the measurement accuracy. Therefore, it is preferable to ensure at least four measurement points as mentioned above.

What is claimed is:

1. A jig for positioning an inner tube and a transition piece of a combustor for a gas turbine when assembling the combustor, in a state where the transition piece is temporarily installed in the chamber, the jig comprising:

an alignment member that has an outer circumferential shape which is substantially the same as an inner circumferential shape of the transition piece and inserted into the transition piece to determine an installation position of the transition piece;

a support that is fixed to an installation portion of the chamber, where a top hat for retaining the inner tube is installed, by fastening a bolt; and a rod that is fixed to a center of the alignment member at an end with a longitudinal axis thereof being perpendicular to the surface of the alignment member and is fixed to the support at the other end, wherein an outer diameter of the outer circumference is smaller than an inner diameter of the transition piece so as to form a gap between the outer circumference and the transition piece, and the alignment member is a circular disk including a plurality of holes or concaves to reduce a weight of the alignment member.

2. The jig according to claim 1, wherein when an inlet portion of the transition piece has a circular inner circumference, the alignment member has a circular outer circumference.

3. The jig according to claim 1, wherein the alignment member has the outer circumference that permits measurement on at least four points when positioning the transition piece.

* * * * *